US005330721A

United States Patent [19]

Tervamäki

[11] Patent Number: 5,330,721

[45] Date of Patent: Jul. 19, 1994

[54] STEP PIPETTE

[75] Inventor: Jukka Tervamäki, Helsinki, Finland

[73] Assignee: Nippon Zeon Company, Ltd., Tokyo, Japan

[21] Appl. No.: 45,534

[22] Filed: Apr. 9, 1993

[30] Foreign Application Priority Data

Apr. 13, 1992 [FI] Finland ..... 921648

[51] Int. Cl.[5] ..... B01L 3/02

[52] U.S. Cl. ..... 422/100; 422/99; 436/180; 73/864.13

[58] Field of Search ..... 422/99, 100; 436/180; 73/864.11, 864.13, 864.16

[56] References Cited

U.S. PATENT DOCUMENTS

| | | | |
|---|---|---|---|
| 2,736,551 | 7/1978 | Sturm et al. | 141/27 |
| 4,268,481 | 5/1981 | Suovaniemi et al. | 422/100 |
| 4,284,604 | 8/1981 | Tervamaki | 422/100 |
| 4,399,712 | 8/1983 | Oshikubo et al. | 422/100 |
| 4,415,101 | 11/1983 | Shapiro et al. | 222/288 |
| 4,554,134 | 11/1985 | Tervamaki et al. | 422/100 |
| 4,760,939 | 8/1988 | Ball et al. | 422/100 |
| 4,909,991 | 3/1990 | Oshikubo | 422/100 |
| 5,104,624 | 4/1992 | Labriola | 422/100 |

FOREIGN PATENT DOCUMENTS

| | | |
|---|---|---|
| 58875 | 11/1981 | Finland . |
| WO84/04056 | 10/1984 | PCT Int'l Appl. . |
| 2045641 | 6/1983 | United Kingdom . |

*Primary Examiner*—James C. Housel
*Assistant Examiner*—Lien Tran
*Attorney, Agent, or Firm*—Armstrong, Westerman, Hattori, McLeland & Naughton

[57] ABSTRACT

A step pipette, which has a dosing rack and therein a dosing toothing, a strike meshing with the dosing toothing, a filling rack connected with the dosing rack by a gear, a striker spring as well as a release member for releasing the tension of the striker spring after the last full-lenght stroke. The solution ensures that also the last liquid dose is always full.

8 Claims, 2 Drawing Sheets

STEP PIPETTE

FIELD OF INVENTION

The invention relates to step pipettes, by means of which liquid drawn by a piston may be dosed out in several smaller doses.

BACKGROUND OF ART

Step pipettes are known, which have a piston movable in a cylinder, a longitudinal pinion rack in a piston rod, a striker bearing against the pinion rack by the force of a spring as well as actuator for the striker, by means of which actuator the striker is forced to push the pinion rack drawn upwards and thereby also the piston by a desired distance downwards shorter than the entire moving distance of the piston. In the publications FI-60137 (corresponds to GB-2045641) and FI-77166 (corresponds to WO 84/04056), such pipettes are described, which additionally have a filling rack connected to the piston rod by means of a pinion, which filling rack is pressed to draw the piston to its upper position.

One problem in connection with e.g the above-mentioned step pipettes has been the fact that the last dose to be injected out often remains incomplete, since the pinion rack is no longer capable of transferring by the entire desired distance.

GENERAL DESCRIPTION OF INVENTION

The main object of the invention is to provide a step pipette furnished with a press-down filling rack, in which step pipette also the last liquid dose injected out is full. This is achieved by means described in claim 1. Certain preferred embodiments are described in the other claims.

Essential in the invention are a striker bearing against a pinion rack by a force of a spring as well as a release mechanism for the spring of the striker, which release mechanism prevents the striker from engaging the pinion rack, when there is no longer a full dose to be pressed out.

DETAILED DESCRIPTION OF EMBODIMENT OF INVENTION

Figure 1:
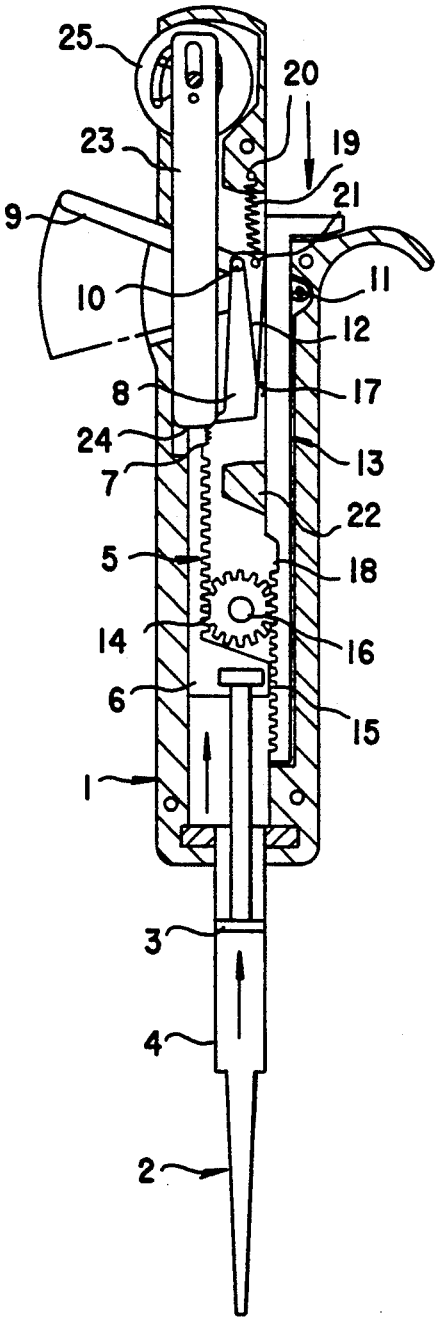
FIGS. 1-3 show the pipette in various steps of operation.

A preferred embodiment of the invention is next described in more detail.

The main parts (FIG. 1) of the pipette are a hollow, longitudinal handle 1 and a cylindrical piece 2 located at its lower end. To the cylindrical piece is fitted a piston 3 movable in a cylinder 4. The jet of the cylindrical piece is tapered and a jet container for liquid is intended to be fixed thereto.

To the upper end of the rod of the piston 3 has been fixed a dosing rack 5. It has been fitted to be slidable in the longitudinal direction of the handle on its one side. The rack 5 has been fixed to the rod of the piston 3 by means of an extension 6 extending to the middle of the handle.

At the upper end of the dosing rack 5, on its inwardly extending side, has been located a dosing toothing 7. Together therewith operates a striker 8, which has been journalled on a lever 9 at a point 10. The free end of the lever 9 extends from an opening in the handle outside the handle into the side of its dosing tube 5. On the opposite side, the other end of the lever 9 has been journalled on the handle at a point 11.

There is a sharp pick point at the lower end of the striker 8, which point engages the dosing toothing 7, when the lever 9 is pressed downwards.

The striker 8 has been also connected with a striker spring 12, which presses the striker against the dosing toothing 7.

Figure 2:
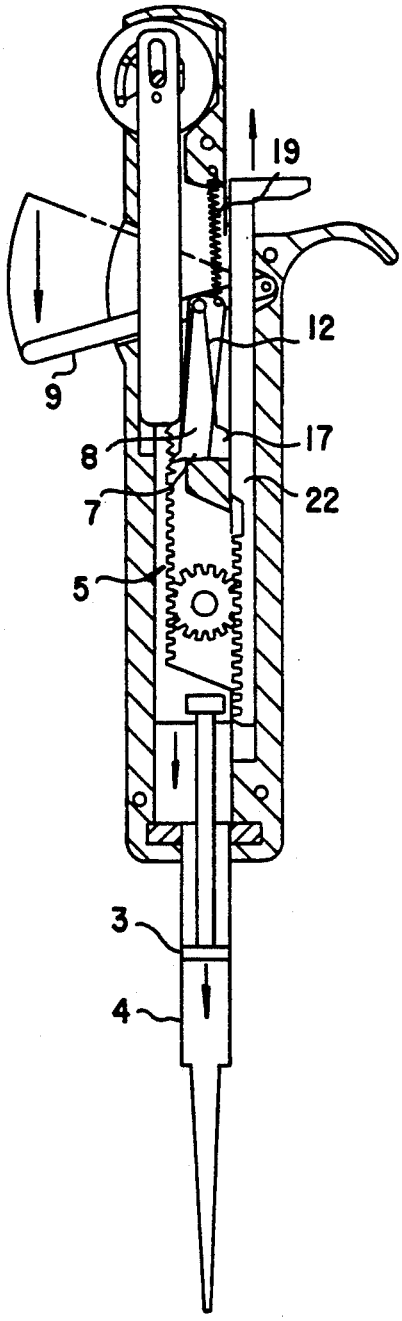

When the dosing rack 5 rises up, the piston 3 sucks in liquid. By means of the lever 9 and the striker 8, it is possible to push the rack 5 and thereby also the piston 3 downwards by predetermined steps and thereby also to dose the liquid sucked in as smaller, predetermined doses (FIG. 2).

The dosing rack 5 is drawn up by means of a filling rack 13 (FIG. 1). It is parallel to the dosing rack 5 and placed on the handle on the opposite side relative to the dosing rack. At the lower end of each rack 5 and 13 have been located on sides opposite to each other longitudinal equally divided toothings 14 and 15 as well as a gear 16 located therebetween and in mesh with both of them. The upper end of the filling rack 13 extends outside the handle. When the filling rack 13 is thus pressed into the lower position, the dosing rack 5 rises up into its upper position. Similarly, when the dosing rack 5 is pressed downwards, the filling rack 13 transfers upwards.

One end of the striker spring 12 (in this connection a V-shaped wire or leaf spring fitted around the journalling point 10) has been fixed to the striker 8 and the other, free end 17 bears against the filling tube 13 such that the spring tends to press the striker towards the dosing toothing 7. As a release element of the striker spring 12 is in this case a gap, a slot, a hole or a rack end 18 located approximately in the middle of the filling rack 13, which rack end acts as a deviation for the free end 17 of the spring. When the free end 17 contacts the deviation 18, the tension of the spring 12 is released.

Figure 3:
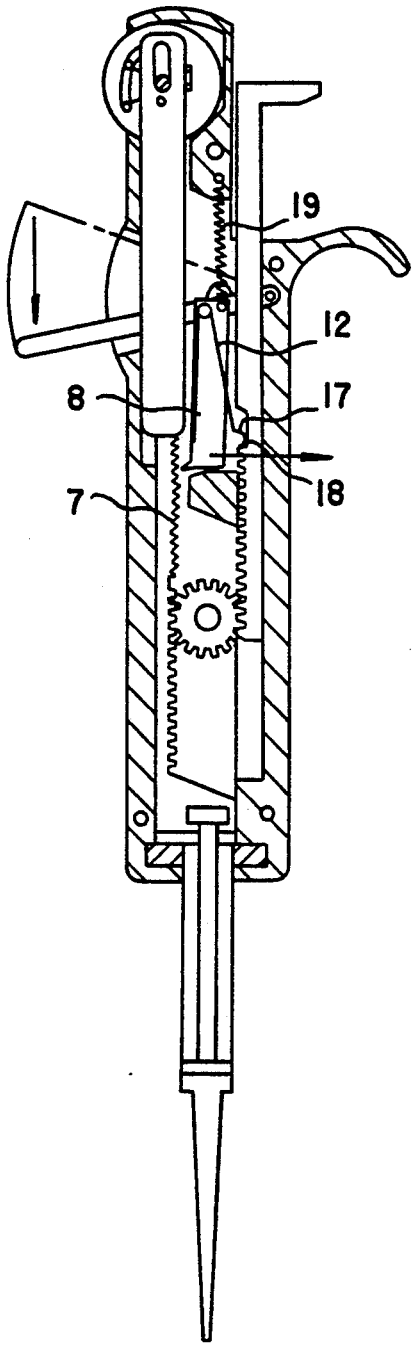

The location of the deviation 18 in the filling rack 13 is determined such that the end 17 of the spring 12 contacts the deviation during the last full dosing stroke. However, owing to the friction between the dosing toothing 7 and the point of the striker 8. The striker does not disengage from the toothing 7 during the stroke, until after it returns to the upper position (FIG. 3).

The striker 8 is also in connection with a loosening spring 19 for loosening the striker from the toothing 7. The loosening spring 19 is a draw-spring, whose upper end has been fixed to the handle above the striker 8 at a point 20 and whose lower end has been fixed to the striker 8 eccentrically relative to the journalling point 10 to a point 21 such that the return spring also tends to turn the striker out of the toothing 7. At the same time, the return spring 18 acts as a return spring for the lever 9.

Naturally, the force of the loosening spring 19 must not be so high that the striker would loosen from the toothing 7 during the last stroke, when the end 17 of the spring 12 enters into the deviation 18. The friction force between the striker 8 and the toothing 7 is first of all determined by the friction between the piston 3 and the cylinder 4. When so desired, the loosening during the stroke may also be prevented by means of a suitable design of the point of the striker 8 and the toothing 7.

The lower limit of the movement of the striker 8 is determined by a limiter 22 fixed to the handle (FIG. 2).

The striker 8 extends in the cross direction to the side of the dosing toothing 7. The engagement point of the striker 8 with the toothing 7 is determined by an adjusting rod 23 parallel with the toothing 7 and placed on its side. Its lower end has been rounded into a cam 24, which rises the striker 8 out of the toothing 7 during the rising-up step of the striker. When the striker 8 is pressed down, its point is pressed into the toothing 7 immediately from below the cam 24.

For adjusting the lenght of the dosing stroke, the adjusting rod 23 has been made movable in the longitudinal direction relative to the handle. Therefore, on the upper end of the rod 23 has been journalled an adjusting wheel 25, whose axis extends across a longitudinal groove of the rod. In addition, the rod 23 has been eccentrically journalled on the wheel 25. When the wheel is thus turned, the rod 23 may be transferred (FIG. 1).

The FIGURES show only a one-channel pipette, but the invention may naturally, as such, be applied also to multiple-channel pipettes.

I claim:

1. A step pipette, comprising:

a frame;

a cylinder provided on said frame;

a piston provided within said cylinder and movable in a direction between a lower and an upper position within said cylinder;

a dosing rack supported by said frame which is parallel to said direction and which is fixed to said piston, said dosing rack being provided with a dosing toothing;

a striker supported by the frame and movable between an upper and a lower position, a portion of said striker capable of meshing with the dosing toothing for transferring the dosing rack and the piston downwards by predetermined strokes;

said dosing rack also including a longitudinal transmission toothing, a gear in mesh with said longitudinal transmission toothing and supported by said frame, a filling rack supported by said frame parallel with the dosing rack, a second longitudinal transmission toothing provided on said filling rack, which is in mesh with the gear from the opposite side relative to the transmission toothing of the dosing rack;

a striker spring means for pressing the striker against the dosing toothing;

a release element means on the filling rack for releasing the tension of the striker spring after a last full-length stroke thereby disengaging said striker form said dosing toothing;

a loosening spring for moving the striker from the dosing toothing to an upper disengaged position after the last full-length stroke to thereby allow filling of the cylinder by retraction of the piston;

means for reengaging said striker with the dosing rack.

2. A pipette according to claim 1, wherein the loosening spring simultaneously acts as a return spring for the striker for returning it into the upper position after a stroke of the striker.

3. A pipette according to claim 1, wherein the force of the loosening spring is lower than a force maintaining the striker during a stroke in the dosing toothing without the striker spring means.

4. A pipette according to claim 1, wherein the release element means is a release member moving together with the filling rack.

5. A pipette according to claim 4, wherein the striker spring means has a free end bearing against the filling rack and the release member is a deviation located in the filling rack, into which deviation the free end of the striker spring means is positioned after the last full-length stroke such that the tension of the striker spring is released.

6. A pipette according to claim 5, wherein the striker is journalled at a journalling point on a lever which is movable between a lower and an upper position and the striker spring means is a striker spring having an upside-down V shape.

7. A pipette according to claim 6, wherein the loosening spring is fixed to the striker proximate the journalling point at a location so as to draw the striker upwards away from said cylinder.

8. A pipette according to claim 1, further including an adjusting rod located on a side of the dosing toothing and movable along the dosing toothing, at the lower end of the adjusting rod there is a cam, which loosens the striker from the dosing toothing when the striker is moved upwards away from said cylinder.

* * * * *

UNITED STATES PATENT AND TRADEMARK OFFICE

CERTIFICATE OF CORRECTION

PATENT NO. : 5,330,721

DATED : July 19, 1994

INVENTOR(S) : Tervamäki, Jukka

It is certified that error appears in the above-indentified patent and that said Letters Patent is hereby corrected as shown below:

On the title page, item [73], "Nippon Zeon Company, Ltd., Tokyo Japan" should read --Labsystems Oy, Helsiki, Finland--

Signed and Sealed this

Twenty-ninth Day of November, 1994

*Attest:*

Bruce Lehman

BRUCE LEHMAN

*Attesting Officer*

*Commissioner of Patents and Trademarks*